US008052587B1

(12) United States Patent
Wu

(10) Patent No.: US 8,052,587 B1
(45) Date of Patent: Nov. 8, 2011

(54) YOGA BRICK

(76) Inventor: Ying-Ching Wu, An-Ding Shiang (TW)

( * ) Notice: Subject to any disclaimer, the term of this patent is extended or adjusted under 35 U.S.C. 154(b) by 0 days.

(21) Appl. No.: 12/841,231

(22) Filed: Jul. 22, 2010

(51) Int. Cl.
*A63B 71/00* (2006.01)

(52) U.S. Cl. ..... 482/148; 482/142; 446/125

(58) Field of Classification Search ..... 482/98, 482/106–109, 142, 148; 446/85, 106, 120, 446/124–125, 476; 434/403; 52/783.1, 605–607; D21/671, 694; 248/146, 148
See application file for complete search history.

(56) References Cited

U.S. PATENT DOCUMENTS

| | | | | |
|---|---|---|---|---|
| D152,394 | S * | 1/1949 | Ceverha | D21/662 |
| 5,094,505 | A * | 3/1992 | Nichols | 297/118 |
| 5,118,095 | A * | 6/1992 | Flor | 482/52 |
| 5,154,678 | A * | 10/1992 | Adamczyk et al. | 482/52 |
| 5,318,489 | A * | 6/1994 | Irwin | 482/52 |
| D360,767 | S * | 8/1995 | Fish et al. | D6/349 |
| 5,628,670 | A * | 5/1997 | Hill | 446/487 |
| D385,317 | S * | 10/1997 | Henriksen | D21/671 |
| D449,357 | S * | 10/2001 | Monter Villar et al. | D21/686 |
| D449,662 | S * | 10/2001 | Monter Villar et al. | D21/686 |
| 6,648,715 | B2 * | 11/2003 | Wiens et al. | 446/121 |
| D519,172 | S * | 4/2006 | Penat et al. | D21/671 |
| 7,156,791 | B2 * | 1/2007 | Edwards | 482/148 |
| D560,260 | S * | 1/2008 | Flentye et al. | D21/694 |
| 7,824,319 | B2 * | 11/2010 | Carlesimo et al. | 482/141 |
| 7,922,623 | B2 * | 4/2011 | Flentye et al. | 482/52 |
| 7,927,256 | B2 * | 4/2011 | Flentye et al. | 482/52 |
| 2004/0192523 | A1 * | 9/2004 | Wu | 482/148 |
| 2006/0189448 | A1 * | 8/2006 | Flentye et al. | 482/52 |
| 2006/0189449 | A1 * | 8/2006 | Flentye et al. | 482/52 |
| 2009/0062093 | A1 * | 3/2009 | Clark | 482/148 |
| 2009/0095754 | A1 * | 4/2009 | Liu | 220/380 |
| 2009/0192028 | A1 * | 7/2009 | Shank | 482/148 |
| 2010/0210173 | A1 * | 8/2010 | Maggiore et al. | 446/125 |
| 2010/0240509 | A1 * | 9/2010 | Chen et al. | 482/148 |

FOREIGN PATENT DOCUMENTS

GB 2205046 A * 11/1988

* cited by examiner

*Primary Examiner* — Loan Thanh
*Assistant Examiner* — Daniel Roland
(74) *Attorney, Agent, or Firm* — Alan Kamrath; Kamrath & Associates PA

(57) ABSTRACT

A yoga brick includes first and second casings. Each of the first and second casings includes inner and outer faces spaced along a first axis, a peripheral wall extending between the inner and outer faces, and a first recessed portion formed in the outer face. The first recessed portion includes a wavy holding face having a plurality of anti-slipping ribs. Each of the first and second casings can further include a second recessed portion formed in the outer face thereof. The second recessed portion includes a wavy holding face having a plurality of anti-slipping ribs. The first and second casings can be engaged with each other with the first recessed portion of the first casing aligned with the second recessed portion of the second casing along the first axis and with the second recessed portion of the first casing aligned with the first recessed portion of the second casing along the first axis.

5 Claims, 5 Drawing Sheets

YOGA BRICK

BACKGROUND OF THE INVENTION

The present invention relates to a yoga brick and, more particularly, to a yoga brick that can be held by an exerciser to assist in balance while doing yoga exercises.

A type of currently available yoga brick is made of foam material and can assist in balance of an exerciser doing yoga exercisers. Specifically, when the exerciser stretches or bends his or her body into various yoga positions, the exerciser can hold a yoga brick to assist in balancing his or her body in some of the yoga positions. Conventional yoga bricks have no recesses in the outer surfaces and are, thus, not ergonomic, leading to uncomfortable gripping during use. The conventional recess-free yoga bricks formed of foam material have a small deform extent without adversely affecting the balance of the exerciser when the yoga bricks are subjected to the holding force by the exerciser. To provide gripping comfort and firm gripping, recesses are provided in outer surfaces of yoga bricks for receiving the fingers of the exerciser. However, the structural strength of the yoga bricks is reduced by the recesses. When in user, the deformation of the yoga brick is increased to an extent that may adversely affect the balance of the exerciser. Furthermore, the deformation extent depends on the force applied to the yoga brick. As a result, the exerciser could not predict the deformation extent and could fall or even hurt himself or herself when losing balance.

Thus, a need exists for a novel yoga brick that is not easy to deform and that allows firm gripping by the exerciser.

BRIEF SUMMARY OF THE INVENTION

The present invention solves this need and other problems in the field of tough, ergonomic yoga bricks by providing, in a preferred form, a yoga brick including first and second casings. Each of the first and second casings includes inner and outer faces spaced along a first axis, a peripheral wall extending between the inner and outer faces, and a first recessed portion formed in the outer face. The first recessed portion includes a wavy holding face having a plurality of anti-slipping ribs.

In the most preferred form, each of the first and second casings includes a second recessed portion formed in the outer face thereof. The second recessed portion includes a wavy holding face having a plurality of anti-slipping ribs. The first and second casings can be engaged with each other with the first recessed portion of the first casing aligned with the second recessed portion of the second casing along the first axis and with the second recessed portion of the first casing aligned with the first recessed portion of the second casing along the first axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
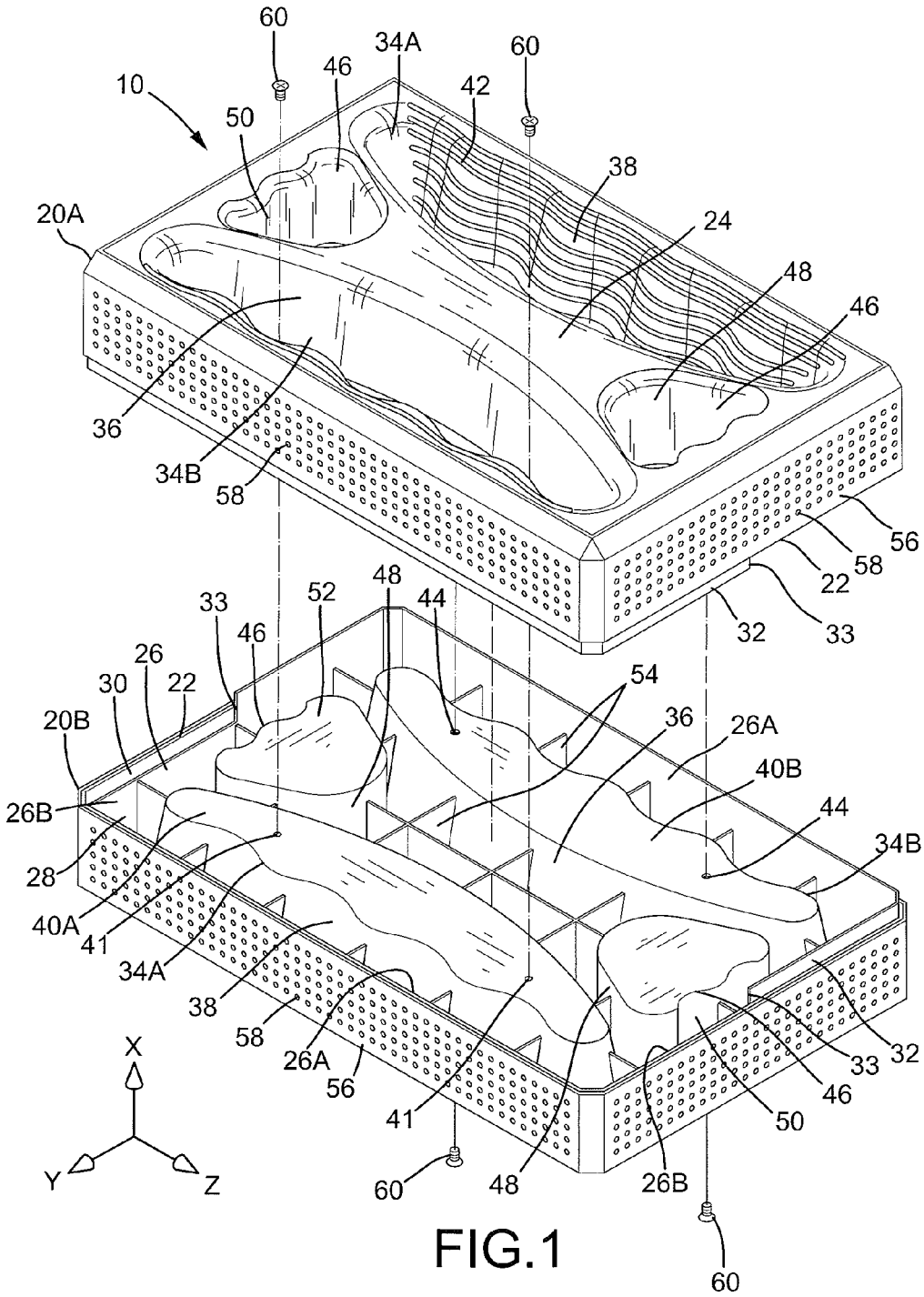
FIG. 1 shows an exploded, perspective view of a yoga brick according to the preferred teachings of the present invention.
Figure 2:
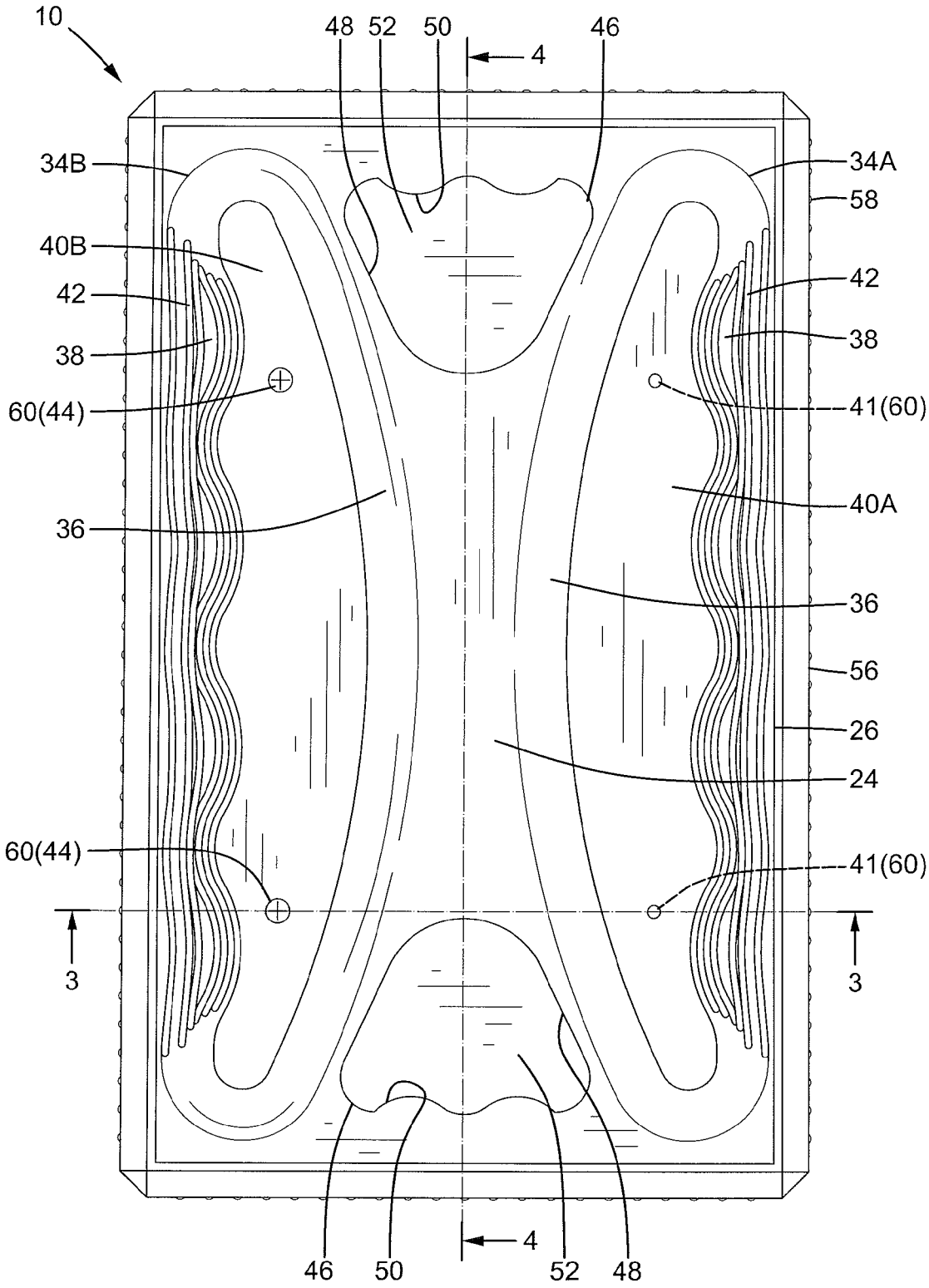
FIG. 2 shows a top view of the yoga brick of FIG. 1.
Figure 3:
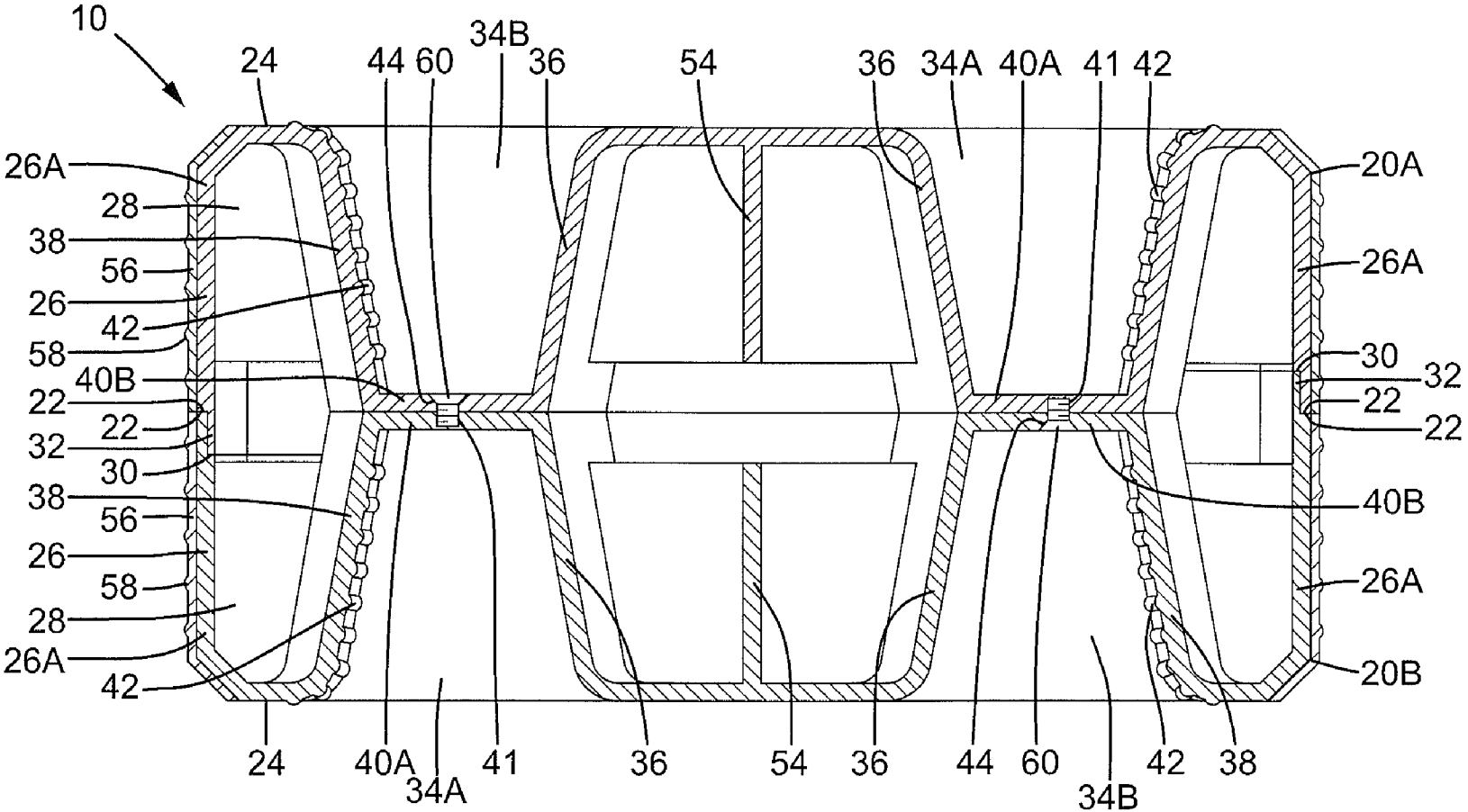
FIG. 3 shows a cross sectional view of the yoga brick of FIG. 2 according to section line 3-3 of FIG. 2.
Figure 4:
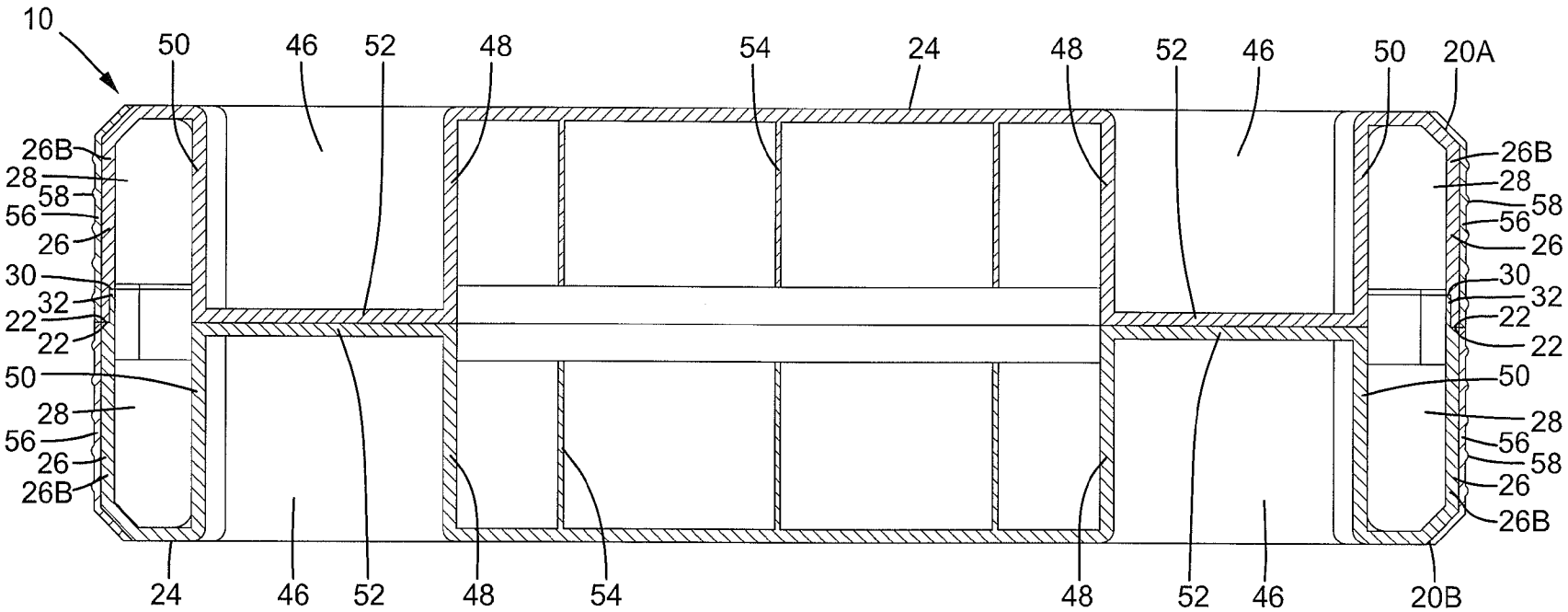
FIG. 4 shows a cross sectional view of the yoga brick of FIG. 2 according to section line 4-4 of FIG. 2.
Figure 5:
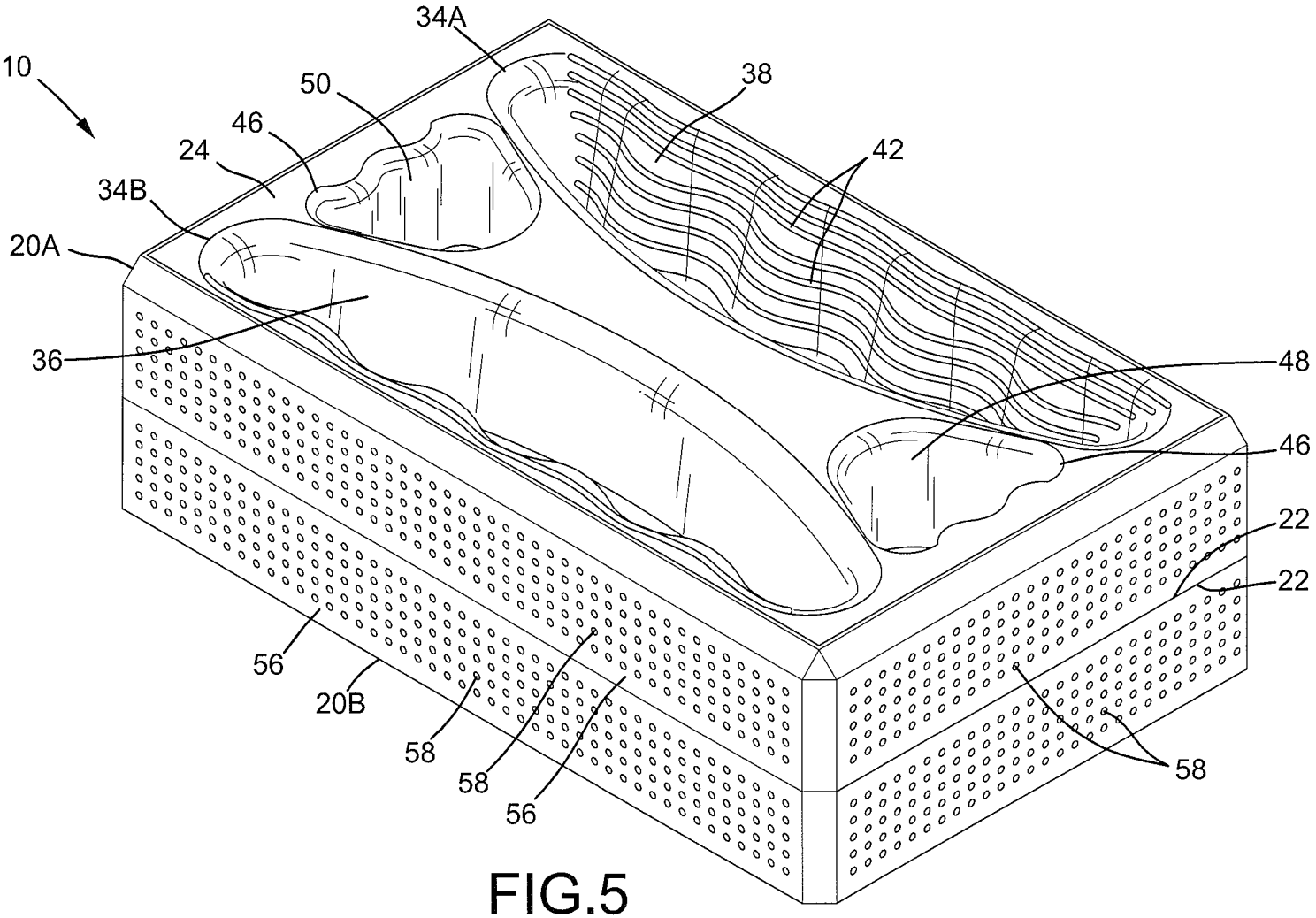
FIG. 5 shows a perspective view of the yoga brick of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "lateral", "length", "depth", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A yoga brick according to the preferred teachings of the present invention is shown in the drawings and generally designated 10. Yoga brick 10 includes first and second casings 20A and 20B. In the most preferred form shown, first and second casings 20A and 20B are formed by injection molding and are identical in shapes, sizes, and structure. Description will only be made with reference to first casing 20A to avoid redundancy.

First casing 20A includes inner and outer faces 22 and 24 spaced along a first axis X. First casing 20A further includes a peripheral wall 26 extending between inner and outer faces 22 and 24. Specifically, peripheral wall 26 includes two parallel, first sides 26A spaced along a second axis Y perpendicular to first axis X and two parallel, second sides 216B spaced along a third axis Z perpendicular to first and second axes X and Y. Each first side 216A has a length along third axis Z larger than a length of each second side 216B along second axis Y. First casing 20A further includes a space 28 extending from inner face 22 towards but spaced from outer sides 24 along first axis X. Furthermore, outer face 24 of first casing 20A further includes a first recessed portion 34A, a second recessed portion 34B and two third recessed portions 46 each of which extends from outer face 24 into space 28 along first axis X. First and second recessed portions 34A and 34B are spaced along second axis Y. Third recessed portions 46 are spaced along third axis Z.

According to the preferred form shown, first recessed portion 34A includes a wavy holding face 38 spaced from one of first sides 26A of peripheral wall 26. First recessed portion 34A further includes a lateral face 36 spaced from holding face 38 along second axis Y and a bottom face 40A extending between holding face 38 and lateral face 36 of first recessed portion 34A and extending perpendicularly to first axis X. Likewise, second recessed portion 34B includes a wavy holding face 38 spaced from the other first side 26A of peripheral wall 26. Second recessed portion 34B further includes a lateral face 36 spaced from holding face 38 along second axis Y and a bottom face 40B extending between holding face 38 and lateral face 36 of second recessed portion 34B and extending perpendicularly to first axis X. First holding face 38 of each of first and second recessed portions 34A and 34B includes a plurality of anti-slipping ribs 42. In the most preferred form shown, lateral faces 36 are intermediate holding faces 38 along second axis Y. Furthermore, bottom faces 40A and 40B are at the same level as inner face 22 along first axis X. Further, bottom face 40A includes two screw holes 41 extending along first axis X, and bottom face 40B includes two through-holes 44 extending along first axis X.

According to the preferred form shown, each of third recessed portions 46 includes a wavy holding wall 50 spaced from one of second sides 26B of peripheral wall 26 along third axis Z and a sidewall 48 spaced from holding wall 50 along third axis Z. Each of third recessed portions 46 further includes a bottom wall 52 extending between holding wall 50 and sidewall 48 and extending perpendicularly to first axis X. Sidewalls 48 are intermediate holding walls 50 along third axis Z. Furthermore, sidewalls 48 of third recessed portions 46 are intermediate lateral faces 36 of first and second recessed portions 34A and 34B. Further, bottom wall 52 of each third recessed portion 46 is at the same level as inner face 22 along first axis X.

According to the preferred form shown, first casing 20A further includes a lip 32 extending from inner face 22 along first axis X and having U-shaped cross sections in the most preferred form shown. Specifically, lip 32 of first casing 20A extends from a middle of one of second sides 26B of peripheral wall 26 across a half of the second side 26B, one of first sides 26A of peripheral wall 26, and a half of the other second side 26B and terminates at a middle of the other second side 26B. Thus, lip 32 has two end faces 33 spaced along third axis Z. Lip 32 has a thickness about a half of a thickness of peripheral wall 26.

According to the preferred form shown, first casing 20A further includes an engaging groove 30 formed in inner face 22 and extending along first axis X and having U-shaped cross sections in the most preferred form shown. Specifically, engaging groove 30 extends from one of end faces 33 of lip 32 through the other half of the second side 26B of peripheral wall 26, the other first side 26A of peripheral wall 26, and the other half of the other second side 26B and terminates at the other end face 33 of lip 32. The cross sections of engaging groove 30 are complementary to the cross sections of lip 32. Furthermore, engaging groove 30 has a depth along first axis X not smaller than a length of lip 32 along first axis Z. A plurality of reinforcing ribs 54 is provided in space 28 and interconnected between outer faces of first and second recessed portions 34A and 34B and between outer faces of third recessed portions 46 to reinforce structural strength of first casing 20A.

According to the preferred form shown, yoga brick 10 further includes an anti-slipping layer 56 formed on an outer peripheral face of peripheral wall 56. Anti-slipping layer 56 can be made of rubber, silicone rubber, or any suitable material by such as second injection molding to be firmly bonded to and to cover the outer peripheral face of peripheral wall 56. In the most preferred form shown, anti-slipping layer 56 includes a plurality of anti-slipping knurls 58.

According to the preferred form shown, first casing 20A is engaged with second casing 20B to form brick 10. Specifically, inner face 22 of first casing 20A abuts inner face 22 of second casing 20B. Lip 32 of first casing 20A is engaged in engaging groove 30 of second casing 20B, and lip 32 of second casing 20B is engaged in engaging groove 30 of first casing 20A. End faces 33 of lip 32 of first casing 20A abut two end walls of engaging groove 30 of second casing 20B, and end faces 33 of lip 32 of second casing 20B abut two end walls of engaging groove 30 of first casing 20A. Thus, first recessed portion 34A of first casing 20A is aligned with second recessed portion 34B of second casing 20B along first axis X, and second recessed portion 34B of first casing 20A is aligned with first recessed portion 34A of second casing 20B. Furthermore, first sides 26A of peripheral wall 26 of first casing 26A are aligned with first sides 26A of peripheral wall 26 of second casing 20B. Further, second sides 26B of peripheral wall 26 of first casing 26A are aligned with second sides 26B of peripheral wall 26 of second casing 20B. Further, bottom face 40A of first recessed portion 34A of first casing 20A abuts bottom wall 40B of second recessed portion 34B of second casing 20B, and bottom face 40A of first recessed portion 34A of second casing 20B abuts bottom wall 40B of second recessed portion 34B of first casing 20A. Further, third recessed portions 46 of first casing 20A are respectively aligned with third recessed portions 46 of second casing 20B along first axis A with bottom portions 52 of third recessed portions 46 of first casing 20A abutting bottom portions 52 of third recessed portions 46 of second casing 20B. Screws 46 are extended through through-holes 44 of first and second casings 20A and 20B into screw holes 41 of first and second casings 20A and 20B. First and second casings 20A and 20B are, thus, assembled together to form yoga brick 10.

In use, an exerciser doing yoga exercises can grip yoga brick 10 according to the preferred teachings of the present invention by first, second, or third recessed portions 34A, 34B, 46 of first and second casings 20A and 20B for balancing his or her body. The fingers of the exerciser can be received in recesses of wavy holding faces 38 or recesses of wavy holding walls 50 with anti-slipping ribs 42 providing anti-slipping function. The palm of the exerciser can be in contact with anti-slipping knurls 58 of anti-slipping layers 56, providing enhanced anti-slipping function.

First and second casings 20A and 20B of yoga brick 10 according to the preferred teachings of the present invention are identical to each other, saving the costs for molds. Furthermore, reinforcing ribs 54 of first and second casings 20A and 20B of yoga brick 10 according to the preferred teachings of the present invention reinforce the structural strength of yoga brick 10 to avoid the risk of undesired deformation while having a light weight.

Now that the basic teachings of the present invention have been explained, many extensions and variations will be obvious to one having ordinary skill in the art. For example, anti-slipping ribs 42 can be formed by forming elongated recesses in holding faces 38. First and second casings 20A and 20B can be engaged with each other by other provisions such as high-frequency welding or applying an adhesive on inner face 22 of one or both of first and second casings 20A and 20B. Furthermore, each of first and second casings 20A and 20B does not have to include second recessed portion 34B and/or third recessed portions 46. Further, each of first and second casings 20A and 20B does not have to include space 28. The number of screw holes 41 and the number of through-holes 44 can be varied according to needs. As an example, each of first and second casings 20A and 20B can include only one screw hole 41 and only one through-hole 44.

Although first and second casings 20A and 20B in the most preferred form shown are identical to each other, first casing 20A can be different from second casing 20B according to the teachings of the present invention. As an example, first casing 20A can only include first recessed portion 34A, and second casing 20B can include first and second recessed portions 34A and 34B. Thus, first recessed portion 34A of first casing 20A can be aligned with first or second recessed portion 34A or 34B of second casing 20B along first axis X after engagement, providing two different holding modes for the exerciser. In another example, first casing 20A can include first and second recessed portions 34A and 34B and two third recessed portions 46, and second casing 20B does not include third recessed portions 46, providing more holding modes.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A yoga brick comprising first and second casings, with each of first and second casings including:

inner and outer faces spaced along a first axis;

a peripheral wall extending between the inner and outer faces; and a first recessed portion formed in the outer face, with the first recessed portion including a wavy holding face having a plurality of anti-slipping ribs, with each of the first and second casings including a second recessed portion formed in the outer face thereof, with the second recessed portion including a wavy holding face having a plurality of anti-slipping ribs, with the first and second casings engageable with each other with the first recessed portion of the first casing aligned with the second recessed portion of the second casing along the first axis and with the second recessed portion of the first casing aligned with the first recessed portion of the second casing along the first axis, with the peripheral wall of each of the first and second casings including an anti-slipping layer formed on an outer peripheral face of the peripheral wall, with the anti-slipping layer including a plurality of anti-slipping knurls.

2. A yoga brick as comprising first and second casings, with each of first and second casings including:

inner and outer faces spaced along a first axis;

a peripheral wall extending between the inner and outer faces; and a first recessed portion formed in the outer face, with the first recessed portion including a wavy holding face having a plurality of anti-slipping ribs, with each of the first and second casings including a second recessed portion formed in the outer face thereof, with the second recessed portion including a wavy holding face having a plurality of anti-slipping ribs, with the first and second casings engageable with each other with the first recessed portion of the first casing aligned with the second recessed portion of the second casing along the first axis and with the second recessed portion of the first casing aligned with the first recessed portion of the second casing along the first axis, with the peripheral wall of each of the first and second casings including two parallel, first sides spaced along a second axis perpendicular to the first axis and two parallel, second sides spaced along a third axis perpendicular to the first and second axes, with the holding face of each of the two first sides of each of the first and second casings spaced from one of the first sides of the peripheral wall, with at least one of the first and second casings including a third recessed portion formed in the outer face thereof, with the third recessed portion including a wavy holding wall spaced from one of the two second sides of the peripheral wall.

3. The yoga brick as claimed in claim 2, with each of the first and second casings including a lip extending along the first axis and extending from a middle of one of the two second sides of the peripheral wall thereof across a half of the second side, one of the two first sides of the peripheral wall thereof, and a half of another of the two second sides and terminating at a middle of the other second side, with the lip having two end faces, with each of the first and second casings further including an engaging groove formed in the inner face thereof and extending along the first axis and extending from one of the two end faces of the lip through another half of the second side of the peripheral wall thereof, another of the two first sides of the peripheral wall thereof, and another half of the other second side and terminating at another of the two end faces of the lip, with the lip of the first casing engaged in the engaging groove of the second casing, with the lip of the second casing engaged in the engaging groove of the first casing, with the two end faces of the lip of the first casing abutting two end walls of the engaging groove of the second casing, with the two end faces of the lip of the second casing abutting two end walls of the engaging groove of the first casing.

4. The yoga brick as claimed in claim 3, with the each of the first and second casings further including a space extending from the inner face towards but spaced from the outer face thereof along the first axis, with each of the first and second recessed portions of each of the first and second casings further including a lateral face and a bottom face extending between the lateral face and the holding face and extending perpendicularly to the first axis, with the lateral faces located intermediate the holding faces along the second axis, with the third recessed portion including a lateral wall and a bottom wall extending between the lateral wall and the holding wall, with the lateral wall of the third recessed portion located intermediate the lateral faces of the first and second recessed portions along the second axis.

5. The yoga brick as claimed in claim 4, with the bottom face of the first recessed portion of each of the first and second casings including a through-hole, with the bottom face of the second recessed portions of each of the first and second casings including a screw hole, with the yoga brick further comprising: a first screw extending through the through-hole of the bottom face of the first recessed portion of the first casing into the screw hole of the bottom face of the second recessed portion of the second casing; and a second screw extending through the through-hole of the bottom face of the first recessed portion of the second casing into the screw hole of the bottom face of the second recessed portion of the first casing.

* * * * *